United States Patent [19]

MacCracken

[11] 3,983,713

[45] Oct. 5, 1976

[54] METHOD OF CREATING AND OUTDOOR ICE SLAB IN SUMMER WEATHER AND OF REDUCING ENERGY REQUIREMENTS FOR INDOOR AND OUTDOOR ICE RINKS

[76] Inventor: Calvin D. MacCracken, 92 Dwight Place, Englewood, N.J. 07631

[22] Filed: May 5, 1975

[21] Appl. No.: 574,748

[52] U.S. Cl. ..... 62/66; 62/235; 272/3

[51] Int. Cl.[2] ..... A63C 19/10

[58] Field of Search ..... 62/235, DIG. 1, 93, 62/66; 272/3

[56] References Cited

UNITED STATES PATENTS 3,495,415 2/1970 MacCracken ..... 62/235

FOREIGN PATENTS OR APPLICATIONS 168,429 9/1959 Sweden ..... 272/3

*Primary Examiner*—William E. Wayner
*Attorney, Agent, or Firm*—Parmelee, Johnson & Bollinger

[57] ABSTRACT

Heretofore it has been completely impractical to try to create and hold ice for the purposes of ice skating, curling or sliding during summer weather unless the area were completely enclosed. This invention presents a method for doing this which is practical not only by keeping refrigeration requirements low but also by eliminating dripping, fogging and surface melting. This method also has the advantage of reducing energy requirements for holding an ice slab under indoor or outdoor conditions. The method includes creating a floor for ice under which tubes or pipes containing an antifreeze solution are laid, connecting a refrigeration plant to chill and recirculate the antifreeze solution, suspending a surface of aluminum foil facing downward covering the entire ice floor at least 10 feet above such floor, mounting fans to recirculate the air from below such aluminum surface to above it, freezing ice by applying water upon the floor, painting the ice white to reflect radiant energy, freezing more ice above the white paint, erecting a solid perimeter fence around the ice floor, blowing air through a header box alongside the rink to dehumidify the air and delivering that air through openings in the perimeter fence onto the ice floor area and certain combinations of the above steps. The low emissivity of the aluminum foil and the high reflectivity of the white paint prevent radiant energy from loading the ice while recirculation fans warm the cool moisture-laden and often foggy air over the ice by conveying it to the warm area above the suspended ceiling.

10 Claims, 7 Drawing Figures

Fig_2_
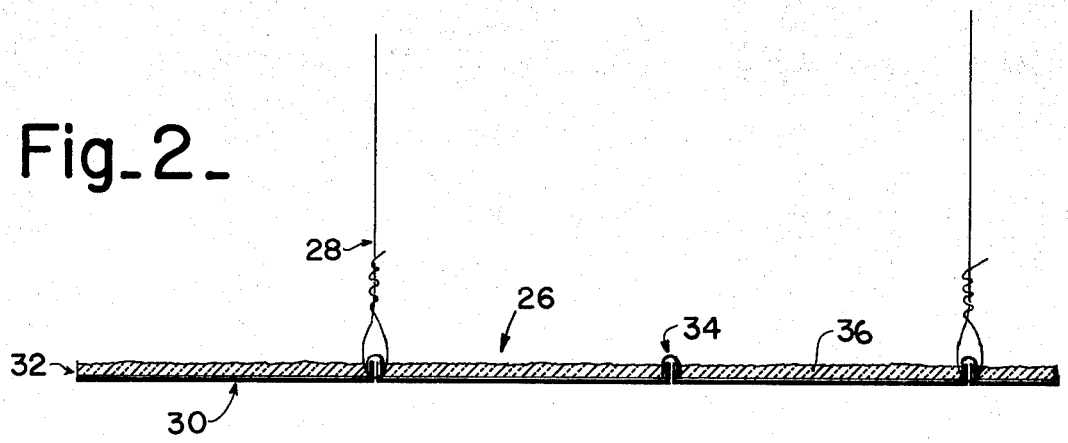
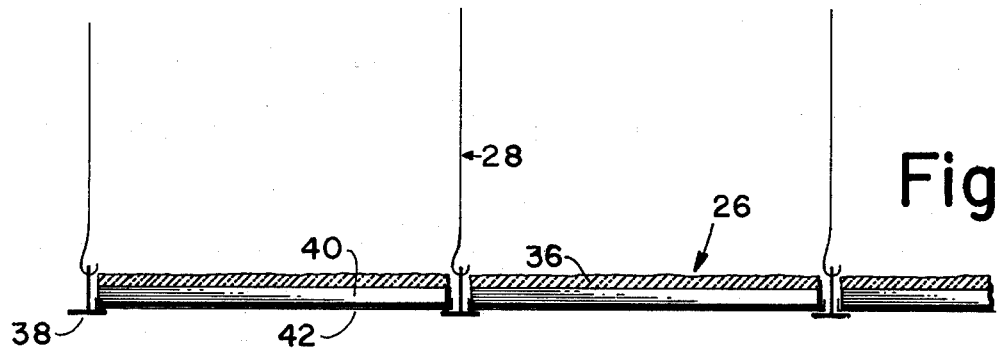
Fig_3_
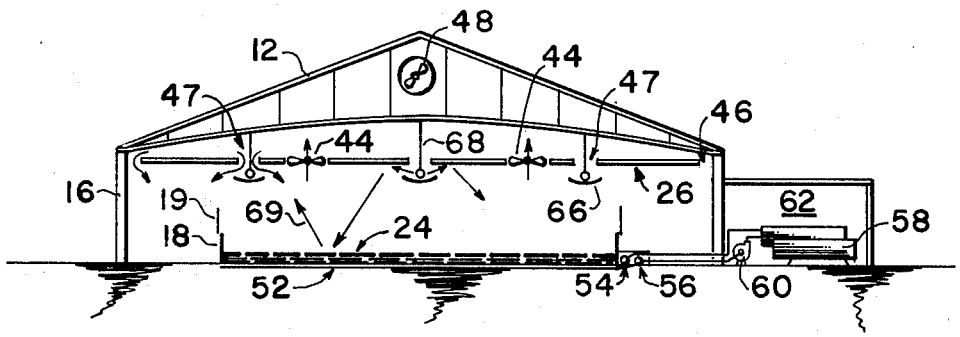
Fig_4_

Fig_5_
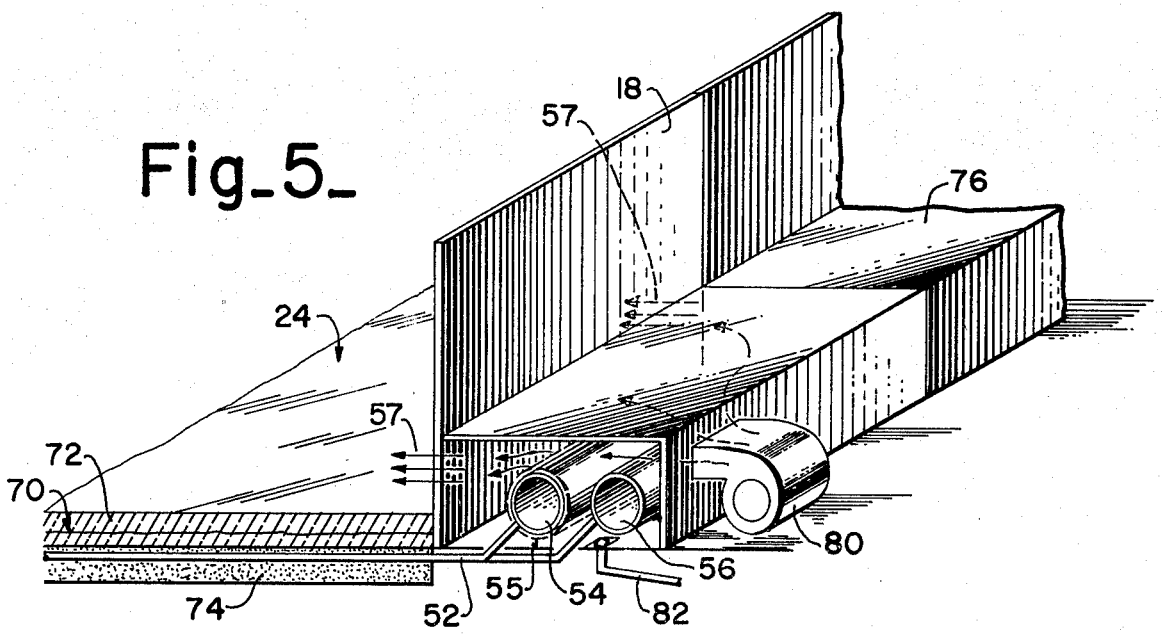
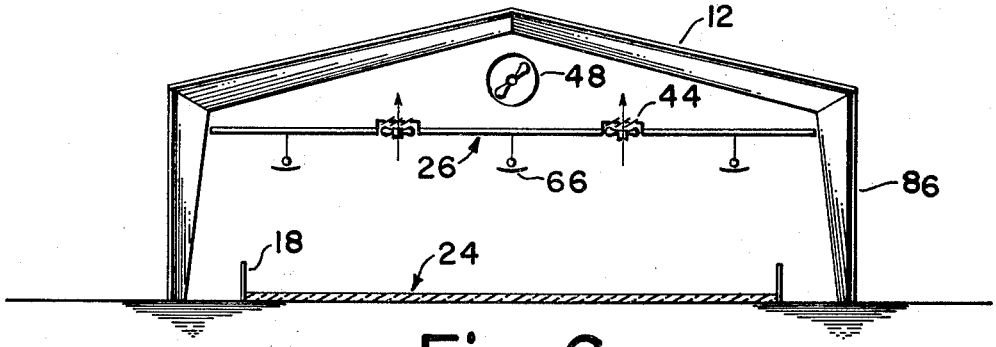
Fig_6_
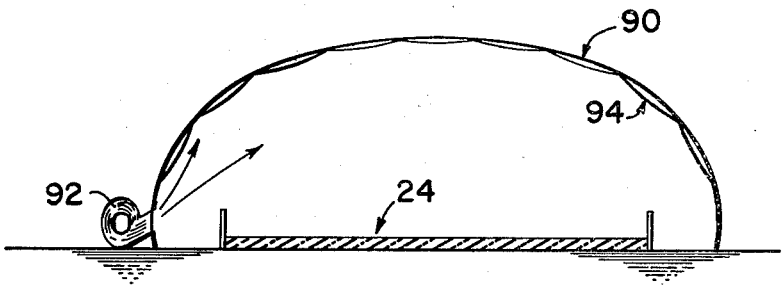
Fig_7_

METHOD OF CREATING AND OUTDOOR ICE SLAB IN SUMMER WEATHER AND OF REDUCING ENERGY REQUIREMENTS FOR INDOOR AND OUTDOOR ICE RINKS

DESCRIPTION

The present invention relates especially to a method for creating an ice slab for ice skating, curling or sliding wherein the outdoor ambient conditions of temperature and humidity exist over the entire rink site even though the ice slab is covered to protect it from direct sun, snow and rain.

It has always been found that to hold ice all year around in a covered outdoor environment of this type is virtually impossible and certainly impractical (a) because the amount of refrigeration tonnage required goes way up as warmer, more humid weather arrives, (b) because dripping from the ceiling becomes very annoying building lumps on the ice surface where it lands on the ice, and (c) because on warm days of high humidity fog covers the ice floor and the air becomes uncomfortably clammy. Therefore such ice skating rinks, curling rinks, or refrigerated toboggan slides have always been seasonal in operation.

Today the demand for ice has become a year-round thing largely because of summer ice hockey and figure skating schools and practice sessions, and it is much easier to keep good operating personnel if they are given year-round jobs instead of only for part of a year. Time is rented out by the hour and frequently such rinks are busy 24 hours per day even in the summer.

The cost of totally enclosing a covered ice area, providing heating and dehumidification, adding refrigeration tonnage and extra lighting, and the general sprucing up to be competitive with indoor arena, has been found to be very expensive. Furthermore, there may be zoning restriction, requirements for more parking space, and loss of an attractive, rustic, outdoor-type atmosphere that brings out many general skaters. In fact the Bureau of Outdoor Recreation will provide matching funds for unenclosed ice rinks but not for enclosed ones, and this is very influential with municipalities who want to have ice rinks since this money, raised from the admission fees to the National Parks, makes significant economic difference.

The present invention makes possible holding ice at summer conditions (1) without increasing refrigeration tonnage, (2) without dripping from the ceiling and (3) generally without fogging. It also (4) eliminates wet ice and (5) reduces energy consumption during the winter season. Further, (6) the amount of energy required for adequate illumination is reduced.

I have found that the heat load on a slab of ice on a covered arena is only one to five percent by conduction of heat from the sides or underneath, is thirty to seventy percent by convection including primarily condensation, and is, surprisingly, 30 to 70 percent by radiation. The prior art and technical literature do not recognize the large effect of radiation and reradiation of heat from the roof or ceiling over an ice rink to the ice.

While some of this radiation is from lights, the large majority of it is from rereadiation of radiant energy which has fallen on the roof exterior or from the radiation to the ice of heat which the ceiling has gained through convection both inside and out.

It is well known that radiant energy is transferred proportional to the fourth power of the absolute temperature and thus as the temperature differential increases, radiant heat transfer becomes a rapidly increasing factor.

In an ice rink arena the large area of ice on the floor is at about 25° F, and the roof or air directly under the roof may be 75° to 100° F or even higher depending on the weather and climate. Thus the temperature differential may be far higher than in an air conditioned space, and the effect or radiant heat transfer will change from a minor one to a very major effect.

Radiation is further directly controlled by the coefficient of "emissivity", the measure of each material's relative ability to radiate compared to a perfect black body. In looking at published tables of emissivity one observes that paint, plaster, brick, cement, mortar, cinder block, stone, wood, asbestos, paper, glass, in short almost any material you would find on an interior surface, have a coefficient above 80 percent. Even white lacquer paint is 80 percent.

However, a tremendous exception to this is aluminum where an oxidized sheet would be about nine percent and polished aluminum foil wound be 4 to 5 percent. Certain expensive metals in polished state are equivalent such as bronze and copper, with polished gold being about two percent. Since aluminum foil is inexpensive, easy to handle and is already used as a facing for insulation materials and as a radiant insulation material itself, it is an advantageous choice.

The invention in one of its aspects provides a method of greatly reducing the flow of radiant energy into the ice slab of a covered ice arena by creating a downward facing surface of aluminum foil over the ice spaced at least 10 feet above the ice. This aluminum suspended ceiling may have air intake openings as will be explained further below.

The reason there is dripping from the ceiling or support members over many prior art ice rinks is because the surface of the ceiling or support members radiate strongly to the ice as caused by their high emissivity values and thus get much cooler because of the loss of heat by radiation. These prior art surfaces reach an equilibrium temperature where the heat flow lost by radiation will be balanced by the heat flow gained by conduction from the roof and convection from the surrounding air and also perhaps by some heat flow gained through radiation from light fixtures. If this temperature is below the dewpoint in the upper part of the arena, condensation will take place and eventually cause dripping.

When the surface has a low emissivity and does not radiate heat to the ice appreciably, the surface does not get cooler and will not go below the dewpoint and consequently will not drip. Also it follows that since the ceiling surface does not get wet, the deterioration of the surface and the materials behind it will not occur as it will when the ceiling is often wet.

In addition to reducing radiant heat flow toward the ice from the covering, this invention includes as part of its method painting the ice with a white reflective paint in order to reflect as much of the remaining radiant energy as possible. This paint is a water-base white paint and is painted over the entire ice surface by spray, brush, drag, mop, or ice resurfacing machine before the ice has reached its desired thickness. After the paint is dry and frozen, more ice is built on top of the paint to a total thickness of about one to two inches to provide paint-free ice for the final skating surface.

This white painted layer procedure in and of itself is not new and is done on many indoor hockey rinks for better appearance and so that visibility of the hockey puck and skaters will be better. However, I have found that used in conjunction with the other steps of this invention they enable economic maintenance of ice during warm months, for the white painted layer is also a step in eliminating radiant heat gain to the ice from extraneous sources such as lights and windows. White paint is very reflective of radiant heat emitted from high temperature sources such as electric lights and the sun, although it is not as good for radiant heat from low temperature sources such as the ceiling and walls.

Furthermore by having a highly reflective aluminum ceiling and a highly reflective white-painted ice floor, the amount of lighting required will be greatly reduced and thus the flow of radiant energy from lights will be less. Safety will be aided because glare is reduced and vision improved by having light come from a wide area of reflective materials rather than discreet sources of light as is commonly done. I have found in experimenting with a full size rink that the installation of an aluminum ceiling and painting the ice white reduced the lighting required by 50% and the refrigeration tonnage by 30%.

Fogging is caused by moisture laden warmer air coming in contact with the colder air stratified over the ice surface. Colder air being heavier tends to settle and remain over the ice. When the moist warmer air encounters the colder air, its ability to hold moisture is reduced, as is well known, and when the temperature falls below the dewpoint fog is formed. In an indoor enclosed rink it is possible to exclude most of the humid outdoor air while the air inside is dryed by condensation on the ice surface or in a dehumidifier. In a covered unenclosed rink humid air is free to enter the area.

To eliminate fogging without excessive condensation on the ice surface it is important to limit the amount of flow of outdoor air onto the ice and yet to provide enough air movement to prevent the stratification of the colder air. The former is done by erecting a perimeter solid fence around the ice surface, such as the usual hockey "dasher" boards and preferably increasing the height of this by transparent panels of plastic or shatterproof glass, as is also common. The controlled air movement to prevent stratification is by fans which pull air from the area over the ice through openings in the aluminum suspended ceiling into the space above the suspended ceiling where it is warmed by the accumulated heat under the roof. This air will then either be discharged outside or be delivered back down around the outside of the suspended ceiling or through other openings in the said ceiling. This recirculation will reduce stratification and will prevent fogging.

An alternate method is to deliver air through openings in the perimeter boards which has been dryed by coming in contact with the cold brine piping in the header trench. The brine pipes are between 10° and 25° F and when air is blown across them condensation will occur which can be drained away. This dryer cooler air will escape into the area low over the ice through openings or joints in the perimeter boards, thus displacing moister air and dispelling fog.

Referring back to the control of radiation, I have also found that the method of creating low emissivity and high reflectivity above the ice and high reflectivity within the ice will greatly reduce the amount of energy required to freeze and maintain the ice slab regardless of whether the ice rink area is totally enclosed or not.

THE DRAWINGS

Referring to the drawings:

FIG. 1 is an overall cut-away perspective view of a full size skating roof under a typical peak roof open-sided building with a horizontal suspended ceiling covering the ice rink and perimeter dasher boards below;

FIGS. 2 and 3 show two types of suspended ceilings similar to present commercial manufacture, FIG. 2 showing painted metal panels hung from wires supporting fiberglass insulation bats and clipped together at their bent up edges by snap-on metal strips, FIG. 3 showing metal T-bars hung from wires supporting rigid panels of sheet rock, fiber board, fiberglass, cellulose fiber, or plastic foam, with aluminum foil facing on the lower side of the panels;

FIG. 4 is a cross-sectional view of the ice rink, the roof with open sides, the suspended ceiling, ventilating fans, lights, brine piping and headers, and refrigeration equipment and recirculating pump;

FIG. 5 shows a perspective detail of the header box attached to the dasher boards, the headers and brine piping, and the blower for supplying dehumidified air, and drain;

FIG. 6 shows application of an aluminum suspended ceiling in a totally enclosed arena building; and FIG. 7 shows an aluminum foil liner attached to the inside of an air-supported structure or tent.

DETAILED DESCRIPTION OF PRESENTLY PREFERRED EMBODIMENTS

Figure 1:
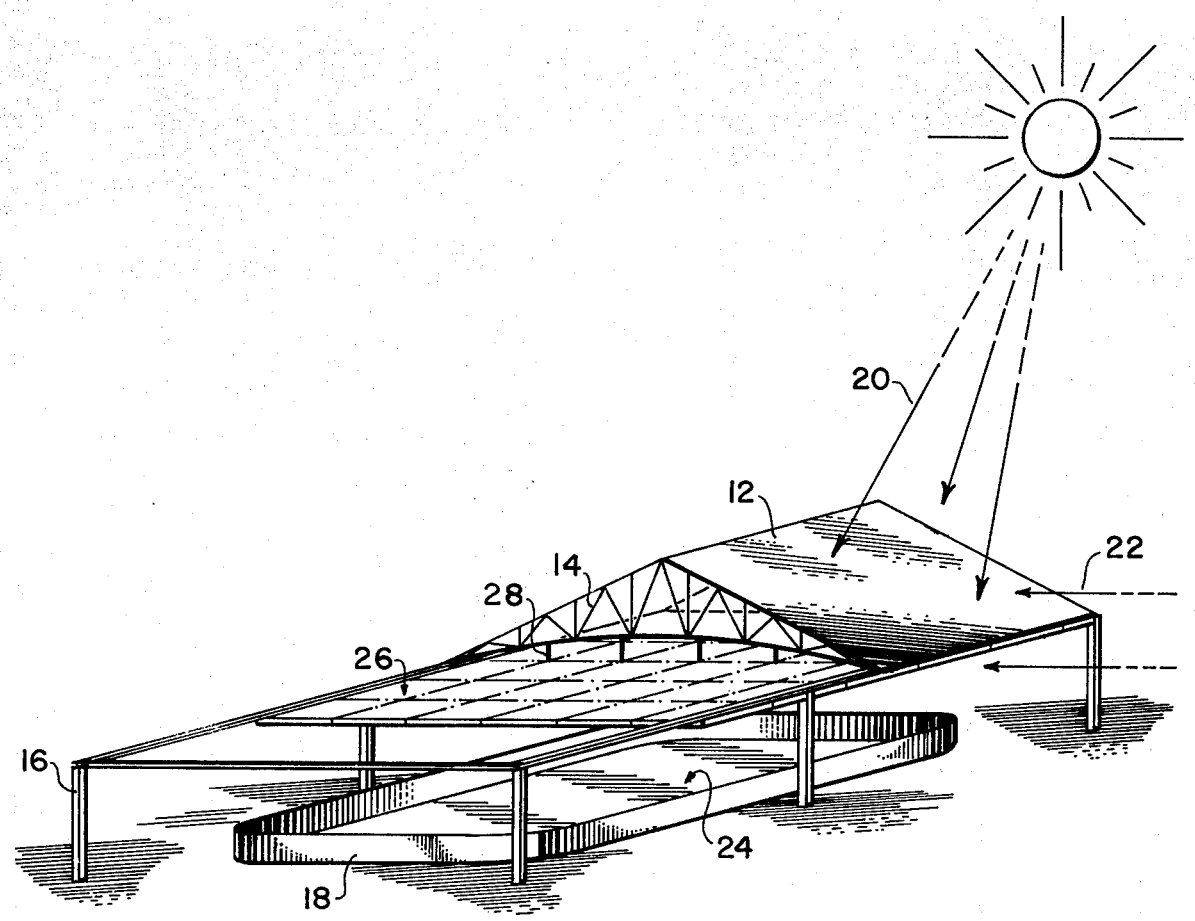

Referring now to the drawings in greater detail, FIG. 1 illustrates a conventional clear span peak roof structure 12 with internal steel truss supporting members 14 supported on columns 16 completely covering a conventional ice rink surrounded with perimeter hockey dashers boards 18. The roof is exposed to solar and sky radiation 20 and convectional heat transfer from wind currents 22 both inside and out. The ice 24 is exposed to radiation from the roof overhead made of normal materials of construction. In the present invention a suspended ceiling 26 of low emissivity and high reflectivity is interposed below the roof support member 14 suspended by wires 28 fastened to members 14.

In FIG. 2 one form of the detail of the suspended ceiling 26 of FIG. 1 is shown. Aluminum metal trays 30 are held together at their edge flanges 32 by metal locking clips 34 and suspended by wires 28 in common fashion. However, the lower surfaces of trays 30 which is the surface directly exposed over the ice is bare aluminum without paint or anodizing or other protective finish. Insulation bats 36 of a light material such as fiberglass rest in the trays to provide conductive insulation on the upper side of the suspended ceiling.

FIG. 3 shows an alternative form of ceiling 26 in which wires 28 suspend inverted "T" bars 38 also made of unpainted aluminum. Panels 40 of a lightweight rigid material, for example, sheet rock, fiber board, fiberglass, cellulose fiber or plastic foam, nest in the angles of the "T" bars to form a suspended ceiling in a common manner. However, the lower surface of panels 40 is covered with bare aluminum foil 42 so that the surface facing the ice below is aluminum. A layer of insulation 36, for example such as fiberglass bats, may be included above the panels.

The surface of reflective aluminum 42 facing downwardly has been described as bare aluminum foil. As an alternative this downward-facing reflective aluminum surface 42 may be formed by a layer of paper or of plastic, for example such as Mylar, coated with a film of aluminum so as to provide a low emissivity, high reflectivity surface. Thus, as used herein the term "surface of reflective aluminum" or "reflective aluminum surface" is intended to include these alternative surfaces 42 (FIG. 3).

FIG. 4 is a cross-sectional view of FIG. 1 also showing additional detail. Peak roofed building 12 is shown supported on open posts 16. The suspended ceiling 26 has vertical blowing fans 44 mounted in openings in ceiling 26 to circulate air from over the rink ice surface 24 to the space above ceiling 26 whence it will return through edge openings 46, fixture openings 47 or be blown outside by ventilation blower 48 in the upper end wall of building 12. Ice is maintained on the rink surface 24 by refrigerant circulated through conventional piping 52 connected in parallel loops to supply header 54 and return header 56. The refrigerant is supplied by a conventional refrigeration machine 58 and recirculating pump 60 mounted in machine room 62 in the usual manner.

Lighting is obtained from lighting fixtures 66 suspended by members 68 so as to be positioned below the level of the bare aluminum (FIGS. 2 and 3). These fixtures 66 are designed to project the light upwardly and to reflect light indirectly upward and along the reflective aluminum ceiling 26 as indicated by the arrows and, as indicated by arrow 69, to rereflect light from just below surface of ice floor 24 which is painted with a white water base paint 70 (FIG. 5) just below the upper ice slab 72 of FIG. 5. This rereflected light 69 bounces off ice and ceiling in all directions advantageously creating glareless illumination, much greater efficiency of lighting with less energy consumed, and less radiant energy striking and being absorbed by the ice, thereby reducing the use of energy in the refrigeration equipment.

The ice surface is bounded by a solid fence 18 which may serve as a "dasher" board for ice hockey. Additionally a transparent fence 19 may be added above the dasher boards to afford protection from being hit by flying hockey pucks and still permit vision of the game or of friends and neighbors who are skating.

FIG. 5 shows an enlarged detail view of the ice floor 24 made up of ice slab 72, ice white paint layer 70, refrigeration pipes or tubes 52, and supporting base sand, concrete or equivalent 74. Perimeter boards 18 enclose the ice surface and header box 76 encloses the header pipes along one side or end of the ice rink. One or more blowers 80 may be positioned to supply air into header box 76 for dehumidifying this air for the purpose of disspelling fog in humid weather. The air delivered into the box 76 will travel over and along cold header pipes 54 and 56 with its moisture condensing on these pipes and dripping off into drain pipe 82. While some of the condensation may freeze into frost on the header pipes, this will be prevented from building up too thick by the inherent insulation value of the frost and also by applying a specific insulation barrier 55 around the pipes, particularly colder supply pipe 54. The air having been cooled and having lost much of its moisture then passes out, as shown at 57, over the ice through opening cracks between parts of the fence 18. Other joints of the header box are sealed to insure the dry air going primarily as indicated at 57 to the ice. This dryer air over the ice will disspell fog and will reduce condensation on the ice surface, keeping the ice of better quality between times of resurfacing and refreezing.

FIG. 6 shows a similar ice arena but with the building totally enclosed with solid side walls 86. While the problem of holding ice in warm humid weather is far less severe in an enclosed building because temperature and humidity may be controlled by well known methods, I have found that a great energy saving may nontheless be made by use of the low emissivity-high reflectivity ceiling 26 combined with the highly reflective ice floor 24. The description of FIG. 4 will apply to the arena of FIG. 6, except that openings for air movement 44 to the space above the ceiling should be louvered to prevent air from passing through when ventilation is not required. Also ceiling 26 should be insulated on the upper side with insulation bats 36 as shown in FIG. 2 and FIG. 3.

FIG. 7 shows an air supported structure 90, commonly known as a "bubble", held up by pressure from a blower 92. In this case outdoor air is continually blown in through the blower so humid conditions prevail much of the time. An aluminum foil inner skin 94 acts to provide the low emissivity which stops the overpowering effect of reradiation from the bubble wall 90. This skin may be laminated to the wall or may be fastened as a drape at intermittent points to provide an air pocket between and to reduce stress on the inelastic aluminum surface. The radiant load on the ice in a bubble is higher than in permanent structures because of the lack of insulation value against solar heat. Even though the exterior surface may be colored white to obtain as high a reflectivity of solar radiation as possible, the outer surface soon becomes gray and dirty and becomes highly absorbent of solar radiation.

Except for radiant energy, as stated earlier, the primary heat load on the ice is by convection. However, I have found that this convection effect is actually a much different physical mechanism than usually conceived. It is not primarily the motion of warm dry air impinging against the ice causing heat flow into the ice, although this is present to a degree. This warm air impingement effect is countered by evaporative cooling of the ice by sublimation of the ice directly from ice to water vapor or evaporation from a wet surface to water vapor absorbed in the impinging air.

The primary heat load on the ice, other than radiation, is the condensation of water vapor from the adjacent layer of air immediately in contact with or close to the ice and the subsequent freezing of this condensation. This condensation and freezing effect may be considered to take place as a single transition, i.e. condensation and freezing both effectively occurring all at one time, a sort of reverse sublimation; and this effect is usually called "frosting", or "frosting up". Thus the data, tables and curves available in the literature on ice rinks, such as in Chapter 56, entitled Ice Skating Rinks, of the Volume on Applications of the Guide and Data Book of the American Society of Heating, Refrigerating and Air Conditioning Engineers, 1974, page 56.3; FIG. 3 gives the required tonnage, or refrigeration capacity, to freeze a given number of square feet of ice rink surface, in terms of wet bulb temperature rather than the normal dry bulb temperature. Inspection of these curves will show a very close and critical relation between wet bulb temperature and tonnage.

For example at 55° Fahrenheit wet bulb temperature one ton of refrigeration (12000 Btuh) will only hold 125 square feet of ice in a heavily used indoor ice rink, while at 45° one ton will hold 264 square feet, or over twice as much.

Thus it can be seen that if dryer air is kept closely adjacent to the ice surface the heat load on the ice will be far less and it will not matter how warm the air may be at a distance away from the ice. Dry air will tend to settle and stratify adjacent to the ice if it is cooler, that is heavier, and if protected and confined by a boundary solid fence and therefore, dry cold air can be used to great advantage to isolate the ice and exclude warm moist air from the ice.

Condensation of water vapor from the air, that is dehumidification, as distinct from "frosting" or "frosting up" is more efficiently done in a separate mode, that is, away from the ice floor itself, because, first, it is not frozen which would require release of the moisture's heat of fusion into the ice floor, but rather the water vapor condenses to liquid in a separate device and is drained away as water; second, this remote removal of water vapor, i.e. dehumidification, avoids the problem of formation of frost on the ice floor which has to be scraped off and new warm water refrozen to get smooth ice again, and, third, the efficiency of remote dehumidification is so much better where there is a fan and velocity rather than the unnatural convection produced by ice on a floor. That is, the air becomes cooled by the ice and tends to stay there instead of moving away, somewhat like a temperature inversion in the atmosphere.

To understand what I mean by unnatural convection consider what would happen if the ice were on the ceiling. Then, the air would lose its moisture to the ice above it, be cooled, and sink away to be replaced by warm moist air again. But on a floor this circulation does not happen except by the haphazard convection caused by skaters.

Ice on a floor will not generally lower the wet bulb temperature below about 55° F while a separate dehumidifying device with a blower can easily bring it down to 45° F.

Thus it can be seen from this analysis that remote dehumidifying does not add refrigeration lead, but actually decreases it and is employed to advantage as one of several steps for reducing energy requirements.

A typical installed tonnage for a usual year-round indoor ice rink is 105 tons to cover peak load conditions. Under such conditions we could assume the conductive load might be about 5% or 5 tons, the radiant load would be 50 tons (45 tons from the ceiling, 5 tons from the lights) and the convective (primarily "frosting" or "frost up") load 50 tons. If, by installing an aluminum ceiling, we reduce the emissivity from 90% to 5%, we eliminate 85% or 45 tons, or 38 tons, and perhaps by using indirect lighting we eliminate 4 of the 5 lighting tons, thus leaving a radiant load of 8 tons. By using dehumidification we reduce the 50 ton convective ice load to around 22 tons and add an average of 10 tons on a 24-hour basis to run the dehumidifier. Thus we would save 66 tons and add 10 tons, for a total saving of 56 tons out of 105, or 53% saving, and only 49 tons, less the lighting saving, is now needed to run the rink instead of 105 tons.

These figures are only assumed and depend on many factors which are hard to control such as usage, infiltration, ventilation requirements, frequency of resurfacing, weather, etc.

In an unenclosed rink the wet bulb temperature will more closely follow the outdoor conditions and such temperatures of 75° or 80° F are encountered. Convective loads will approximately double for each 10° rise, so 75° F wet bulb may require, using our prior example, 4 times 50, or 200 tons. To whatever degree dryer cooler air can be held over the ice surface, even though it is much hotter around the edge and above the fence, great savings can be made. The higher the fence the better and in this case the transparent acrylic plastic panels, sometimes sold under the tradename Plexiglass, will have a very helpful effect of keeping the cooler, dryer air over the ice since they go higher than the skaters heads and thus contain the air turbulence the skaters cause.

Although several different thermal functions are utilized to reduce the load on the ice and thus make possible ice in all climates in an unenclosed structure, or to reduce energy levels to a manageable and survivable consumption in an enclosed ice rink, they all depend upon eliminating the large and hitherto unrecognized radiant load. Other functions may or may not be added depending upon the situation.

From the foregoing, it will be understood that the illustrative embodiments of low emissivity-high reflectivity surfaces above an ice surface as shown above and the methods and structures of utilizing the same, above described, are well suited to provide the advantages set forth. And since many possible embodiments may be made of various features of the invention and as methods and systems here described may be varied in various parts, all without departing from the scope of the invention, it is to be understood that all matter here and before set forth shown in the accompanying drawings is to be interpreted as illustrative and not in a limiting sense in that certain features of these embodiments may be used without a corresponding use of other features without departing from the scope of the invention.

As a reference and computation for the 45 tons of ceiling radiation load on the ice of a typical standard size (85 × 200 ft.) ice rink, as used above, I have referred to the Mechanical Engineers Handbook, edited by Lionel S. Marks, fifth edition, page 380, "Radiant Heat Transmission" by Prof. Hoyt C. Hottel. The formula is given as E (emissivity) $\times 0.173 \times 10^{-8}$ (Stefan-Boltzmann constant) × A (area in sq.ft.) × $T^4$ (absolute temperature) Btu's per hour. In our case the temperature would be the temperature of the ceiling to the fourth power $(T_c)^4$ minus the temperature of the ice to the fourth power $(T_I^4)$. The area would be the area of the ice (17,000 sq.ft.) and we can assume that radiation gained by the ice from sources outside the ceiling directly above the ice are balanced by radiation losses to other areas from the ceiling above the ice.

Using $T_c$ of 65° F (525R) and $T_I$ of 25° F (485R) and average emissivity of 90%, we get $0.90 \times 0.173 \times 10^{-8} \times 17{,}000 \times (525^4 - 485^4) = 546{,}000$ Btu per hour, or dividing by 12,000 Btu per ton we get 45.5 tons.

I claim:

1. The method of creating and maintaining ice for the purposes of ice skating, curling or sliding in an unenclosed area in any climate including the following steps:

a. creating a floor for ice under which tubes or pipes are laid containing a refrigerating fluid,
b. connecting a refrigeration plant to said tubes or pipes to recirculate the refrigerating fluid,
c. suspending from an open-sided roof structure an exposed ceiling surface of reflective aluminum facing downward covering the entire ice floor and spaced at least 10 ft. above such floor,
d. freezing ice on such floor by applying water upon the floor,
e. painting the ice white to reflect radiant energy and freezing more ice over the white paint,
f. erecting a solid perimeter fence around the ice floor, and
g. locating a lightweight insulating layer above said reflective aluminum surface and below said roof.

2. The method of creating and maintaining ice for the purpose of ice skating, curling or sliding in an unenclosed area in any climate as claimed in claim 1, including the step of forcefully circulating the air from below said downward-facing aluminum ceiling to the region above it and below the roof.

3. The method of creating and maintaining ice for the purposes of ice skating, curling or sliding in an unenclosed area in any climate as claimed in claim 1, including the step of positioning indirect lighting means at a level below said reflective aluminum surface to shine upwardly against said downward-facing reflective aluminum surface so as to reduce and disperse radiant energy reaching the ice.

4. The method of creating and maintaining ice for the purposes of ice skating, curling or sliding in an unenclosed area in any climate as claimed in claim 2, including the step of supplying dehumidified cool air at low level at one edge of said ice floor to prevent fog formation.

5. The method of creating and maintaining ice for the purposes of ice skating, curling or sliding in an unenclosed area in any climate as claimed in claim 4, including the step of positioning indirect lighting means to shine against said downward-facing reflective aluminum surface so as to reduce and disperse radiant energy reaching the ice.

6. The method of creating and maintaining a low energy consuming ice slab comprising the steps of:
a. creating a floor for ice under which tubes or pipes are laid containing a refrigerating fluid,
b. connecting a refrigeration plant to said tubes or pipes to recirculate the refrigerating fluid,
c. covering the ice floor with an enclosed insulated building,
d. suspending from the roof structure of said building a ceiling having a downward-facing surface of reflective aluminum covering the entire ice floor at least 10 ft. above such floor, e. freezing ice on such floor by applying water upon the floor,
f. painting the ice white to reflect radiant energy and freezing more ice over the white paint,
g. erecting a solid perimeter fence around the ice floor,
h. positioning indirect lighting means to shine against said reflective aluminum downward-facing surface so as to reduce and disperse radiant energy reaching the ice, and
i. dehumidifying the interior of said building by blowing air in heat exchange relation with said refrigerating fluid and discharging said air toward the area over the ice.

7. The method of creating and maintaining a low energy consuming ice slab as claimed in claim 6, including the step of locating a lightweight insulating layer directly above said aluminum surface.

8. The method of creating and maintaining a low energy consuming ice slab as claimed in claim 7, including the step of mounting air moving means to circulate the air from below said downward-facing aluminum ceiling to above it.

9. The method of creating and maintaining ice for the purposes of ice skating, curling or sliding in an air-supported structure in any climate including the following steps:
a. creating a floor for ice under which tubes or pipes are laid containing a refrigerating fluid,
b. connecting a refrigeration plant to said tubes or pipes to recirculate the refrigerating fluid,
c. erecting by means of one or more air blowers an air-supported structure covering said ice floor, said structure having an innermost inward-facing surface of reflective aluminum,
d. freezing ice on such floor by applying water upon the floor,
e. painting the ice white to reflect radiant energy and freezing more ice over the white paint,
f. erecting a solid perimeter fence around the ice floor,
g. positioning the outlet of said blower or blowers on the inside of the air structure so that the air velocity is directed up away from said ice floor, and
h. positioning indirect lighting means to shine against said inward-facing reflective aluminum surface so as to reduce and disperse radiant energy reaching the ice.

10. The method of creating and maintaining ice for ice skating, curling or sliding in an air-supported structure in any climate as claimed in claim 9 in which dehumidified cool air is supplied at low level at one edge of said ice floor to prevent fog formation.

* * * * *